United States Patent [19]

Birtwhistle

[11] Patent Number: 4,830,352

[45] Date of Patent: May 16, 1989

[54] GATHERING MACHINE

[75] Inventor: Philip Birtwhistle, Banstead, England

[73] Assignee: Portals Engineering Limited, England

[21] Appl. No.: 168,538

[22] Filed: Mar. 8, 1988

Related U.S. Application Data

[63] Continuation of Ser. No. 879,960, Jun. 30, 1986, abandoned.

[30] Foreign Application Priority Data

Jul. 3, 1985 [GB] United Kingdom ..... 8516882
Jul. 9, 1985 [GB] United Kingdom ..... 8517308

[51] Int. Cl.[4] ..... B65H 39/02; B65H 3/08

[52] U.S. Cl. ..... 270/54; 271/11; 271/107; 271/108

[58] Field of Search ..... 270/54–58; 294/64.2; 271/11, 100, 102, 107, 108

[56] References Cited

U.S. PATENT DOCUMENTS

| | | | |
|---|---|---|---|
| 3,071,369 | 1/1963 | Amzrogi | 270/55 |
| 3,181,860 | 5/1965 | Liebenow et al. . | |
| 3,385,593 | 5/1968 | Snellman | 271/11 |
| 3,405,935 | 10/1968 | MacNeill | 271/11 |
| 3,802,696 | 4/1974 | Shigemori et al. | 271/107 |
| 3,967,849 | 7/1976 | Cagle | 294/64.2 |
| 4,155,546 | 5/1979 | Jacobs | 271/11 |
| 4,369,962 | 1/1983 | Spiro | 271/107 |
| 4,373,710 | 2/1983 | Hansen et al. | 270/55 |
| 4,513,957 | 4/1985 | Schaefer, Jr. | 271/11 |
| 4,531,724 | 7/1985 | Lukas et al. | 271/101 |
| 4,549,731 | 10/1985 | Ganz | 271/11 |
| 4,648,588 | 3/1987 | Carrell | 271/108 |

*Primary Examiner*—Eugene H. Eickholt
*Attorney, Agent, or Firm*—Oliff & Berridge

[57] ABSTRACT

A gathering machine for book binding separates each sheet from the bottom of its hopper by a vertically pivotable suction head. The suction is induced by a venturi rather than by vacuum.

4 Claims, 6 Drawing Sheets

GATHERING MACHINE

This is a continuation of application Ser. No. 879,960, filed June 30, 1986, and now abandoned.

DESCRIPTION

This invention relates to a gathering or collating machine used in bookbinding, which machine has a plurality of suction heads. In such a machine a moving element gathers a sheet (or a plurality of sheets) successively from a series of hoppers, each sheet being separated from the bottom of its stack in the hopper by a suction head. Such a machine will be more fully described hereinafter.

In accordance with the present invention a gathering machine with a plurality of suction heads has, as the source of suction for each head, or group of heads, a venturi as opposed to a conventional vacuum source. The effective source at an air suction head is a function of the pressure differential between the source of suction and atmospheric and the capacity of the system, determined largely by the pump and the cross sectional area and length of leads in the system and to the head. For one or a few suction heads a vacuum based system is adequate and such systems are in general use and have been used for multiple suction head gathering machines.

The present invention is based on an appreciation of the inherent deficiency of a vacuum based system which has to work, i.e. overcome the air resistance of all piping, with a maximum pressure drop of 1 atmosphere i.e. circa 15 psi. A venturi achieves its suction by pressure rather than vacuum and the pressure can readily be adjusted high enough to work a multi-head system to provide suction at each head fully effective for all working eventualities. Advantageously a venturi is provided for each suction head or pair of heads.

A gathering or collating machine conventionally comprises a plurality of hoppers arranged in linear series. A stack of single sheets, folded sections (sometimes called signatures) or covers is positioned in each hopper. For convenience in the Specification we will usually refer to any piece to be gathered as a sheet. Thus gathering machine is a broad term to embrace, inter alia, a cover feeders. A driving device moves in a line parallel to and laterally spaced from the row of hoppers. The driving device receives sequentially from each hopper a sheet withdrawn from the base of a respective stack this procedure involving a separation of the bottom section or section of the stack and a lateral transfer to the driving device. It is with the means for separation that the present invention is particularly concerned. It will be appreciated that the driving device having received a sheet section from each hopper ends up with a book for binding.

The invention will now be described by way of example and with reference to the accompanying drawings all of which are partly diagrammatic and wherein.

Figure 1:
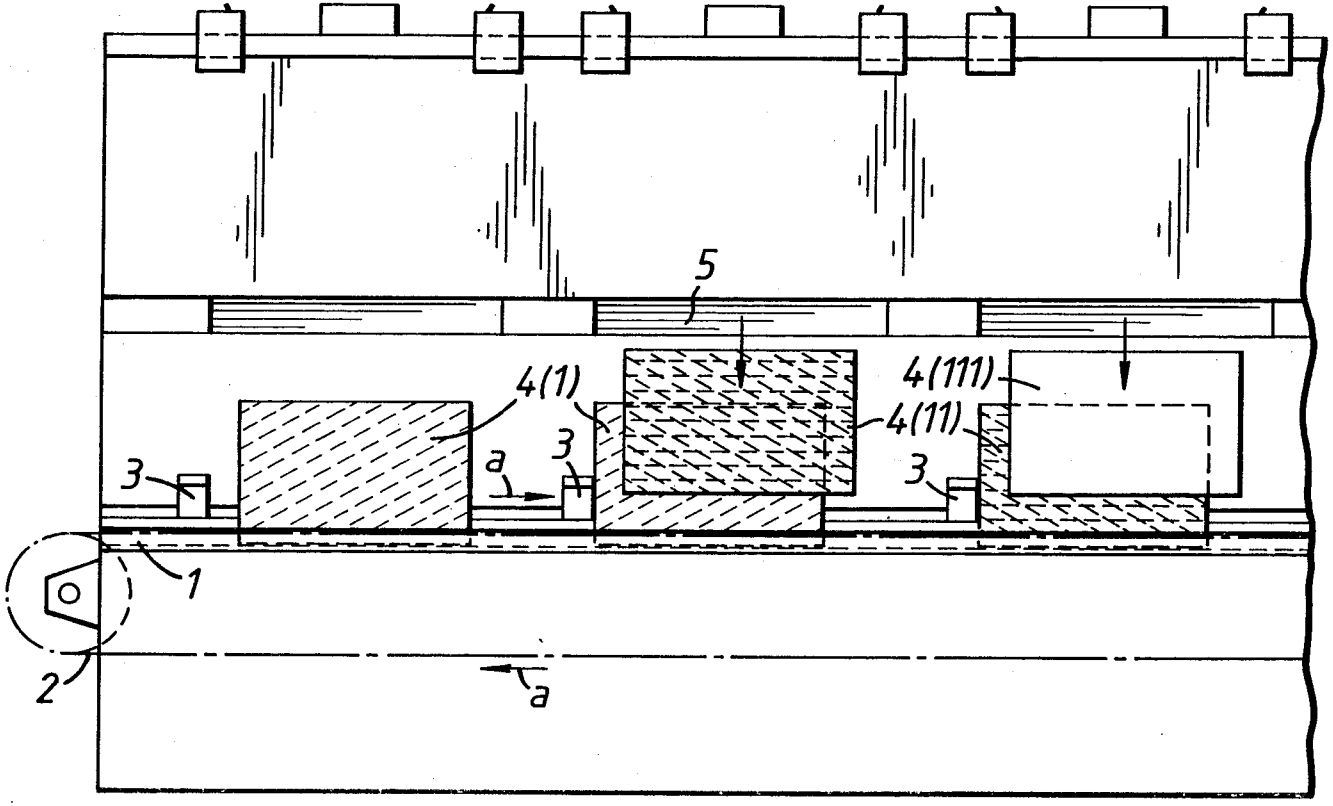
FIG. 1 is a view from one side of a gathering machine.

Referring initially to FIG. 1 of the drawings in the machine illustrated a raceway 1 has a drive chain or equivalent member 2 propelling drive elements 3 in the direction of the arrows a. Sheets signatures or covers 4, hereinafter referred to as sheets are gathered from stacks at the other side of the machine and discharged successively onto the raceway 1 by means to be described. Thus, as illustrated, sheet 4(1) is seen deposited on the raceway awaiting drive element 3 and then being pushed along raceway along an appropriate guide channel to a position under a delivery slot 5 where another sheet 4(11) is dropped behind it. Similarly 4(1 and 4(11) are pushed along to have 4(111) dropped behind them. The procedure carries on as illustrated through a plurality of stations until the book is fully assembled. The remainder of the description deals with the means for gathering and separating sheets successively from the bottom of stacks in which they are loaded and reference here will be made to FIGS. 2 to 6 of the drawings.

Figure 2:
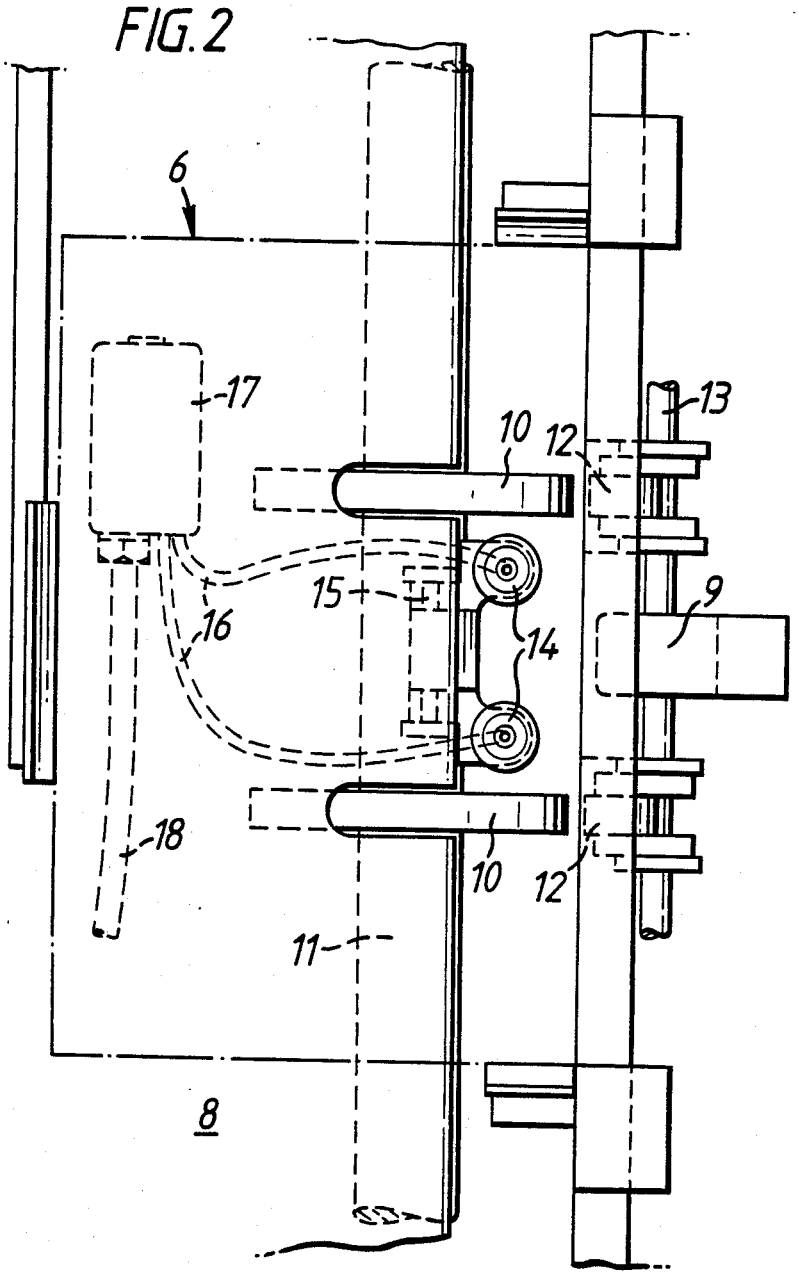
FIG. 2 is a plan view of one of a plurality of feeding means in accordance with the invention and for conveying a sheet from the bottom of a stack at one side of the machine to the side of the machine illustrated in FIG. 1.
Figure 3:
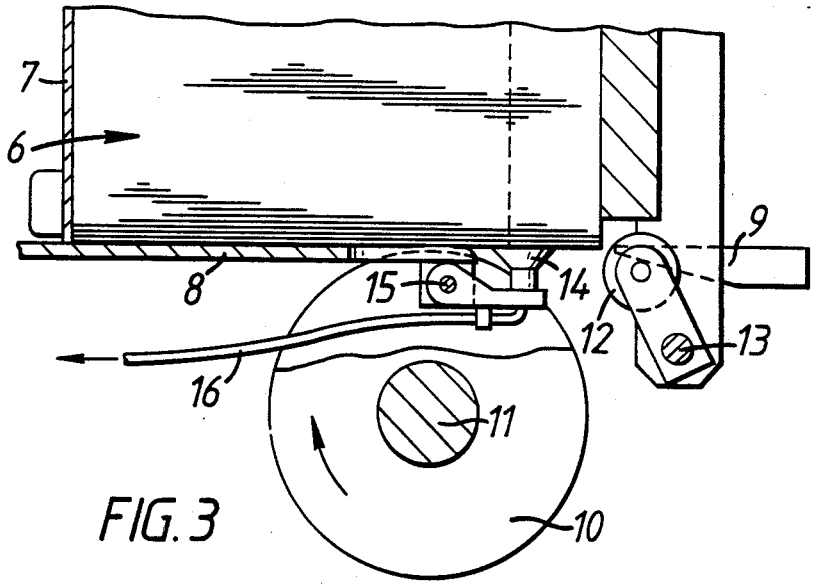
FIGS. 3 to 6 are side views of the feeding means of FIG. 2 at various stages of the operating cycle.
Figure 4:
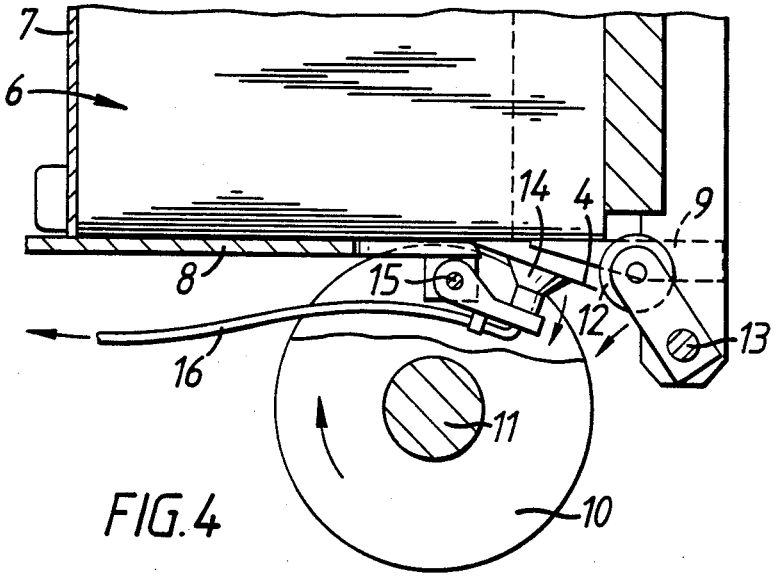
Figure 5:
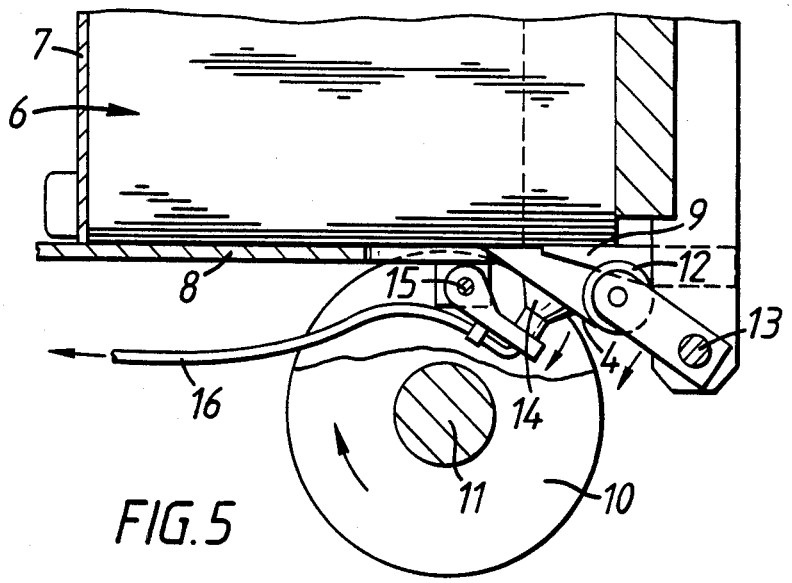
Figure 6:
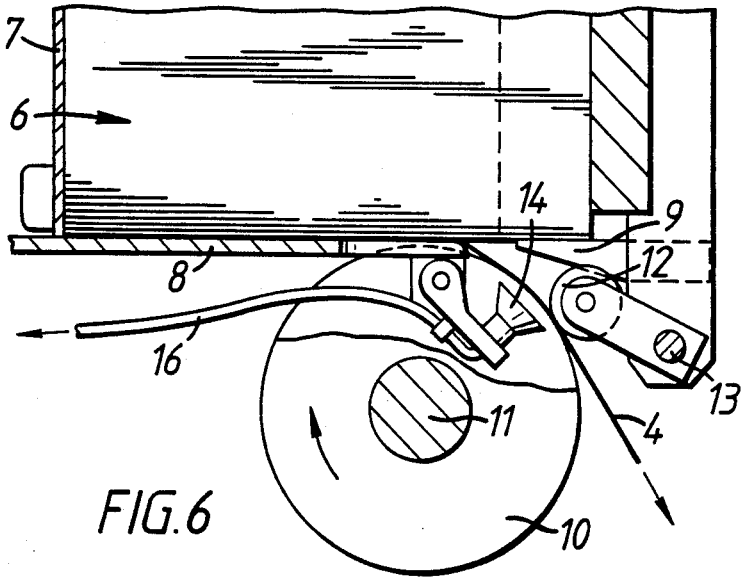

A stack 6 of similar, i.e. carrying the same content, sheets is placed in each hopper 7. The floor 8 of the hopper leaves the front part of the stack unsupported. A retractable support device 9 in the form of a pair of fingers supports the stack 6 in this region. Immediately under the stack is positioned a pair of rollers 10 driven to rotate about a fixed axis 11. Behind and below the stack is a pair of smaller diameter idle rollers 12 mounted for pivoting motion in a vertical plane about an axle 13. The part of the assembly with which we are concerned is completed by a pair of suction heads 14 pivoted for vertical movement about an axis 15. The operation is as follows:

Referring first to FIG. 3 the stack 6 of sheets 4 rests in the hopper 7 with the suction heads 14 in contact with the lower sheet in the hopper. In FIG. 4 one can see the front part of the lower sheet 4 being engaged and drawn down by the suction heads 14 and this initial separation can be enhanced by means (not shown) such as jets of air. As the suction heads 14 move downwardly pulling the sheet 4 with them the support device 9 moves rearwardly to support the remaining sheets in the hopper (FIG. 4). The suction head 14 and sheet 4 continue downwardly as seen in FIG. 5 and the idle roller 12 pivots downwardly so that ultimately the idle roller 12 and the driven roller 10 co-operate (FIG. 6) to provide a nip which draws the sheet downwardly off the stack to the front of the machine as shown in FIG. 2.

Each suction head in the pair is connected through relatively short pipes 16 to a venturi-type suction device 17. Alternative devices are shown in diagrammatic FIGS. 7 and 8.

Figure 7:
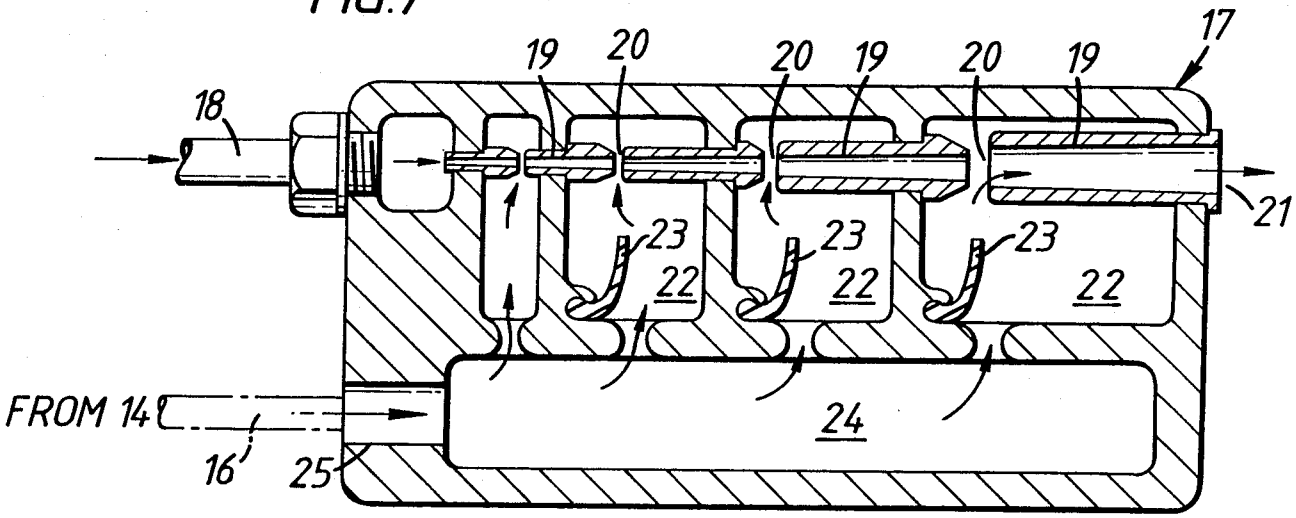
FIG. 7 is a sectional view of a suction device for the means of FIGS. 2 to 6.

The venturi device 17 in FIG. 7 is connected to a line 18 (FIG. 2) and has a gradually widening venturi passage 19 having a series of annular openings 20 and a discharge orifice 21. Air under sufficiently high pressure is driven through the widening passage 19 to exhaust with suction developed at openings 20. Each opening 19 is located within an individual suction chamber 22. The chambers 22 in turn open via resilient flap valves 23 to a common chamber 24 and a suction inlet 25 from the suction heads.

Figure 8:
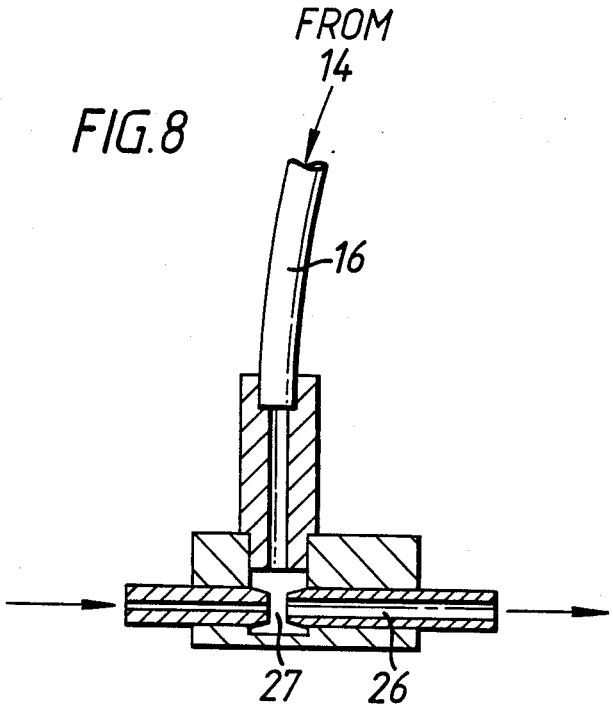
FIG. 8 is a simplified and presently preferred form of suction device.

The simpler and presently preferred device of FIG. 8 has a widening venturi passage 26 with a single annular opening or gap 27. Air is again driven through passage 26 in the direction of the arrows with suction at 27. The suction inlet pipe 16 communicates with a chamber around 27.

Fundamentally the advantage of the present invention arises from the ability to work with high vacuum (perhaps 20 cm of mercury higher than obtainable with a vacuum pump) with a low capacity. Thus the present invention uses 4 mm outside diameter piping as opposed to 30 mm. The system of the present invention works at the order of 60 pounds/square inch and this gives a very rapid response time at the heads which can effectively be switched on and off. Thus:

(1) Because of the small size of venturis they can be mounted very close to the suction heads and hence provide much quicker reaction times;

(2) The tendency to become blocked by paper dust is diminished and if such a blockage does occur, it can be cleared by putting a finger over the exhaust port of the venturi which creates a large back pressure which blasts any obstruction clear.

(3) The devices are small enough and cheap enough to be mounted one per suction head instead of being connected, several to a single valve. This means that if a pair misses, the other pairs do not lose suction and fail to pull down the paper.

Additional advantages (1) and (3) above arise essentially from providing an individual suction device with each suction head or pair of heads.

I claim:

1. A gathering machine comprising:

a moving element operable to gather and collate sheets from a series of hoppers, each hopper adapted to carry a stack of sheets;

an individual suction creating device for each hopper for withdrawing a bottom sheet from a respective stack, each suction creating device comprising a suction head movably mounted to engage and detach said bottom sheet, a venturi suction source and pipe directly connecting the venturi suction source to said suction head; and means for transferring the detached sheet onto the moving element.

2. A gathering machine according to claim 1, wherein each suction creating device comprises multiple suction heads.

3. A gathering machine according to claim 1, wherein the suction source is a widening venturi passage connected to an air line, with at least one annular opening to a suction chamber.

4. A gathering machine according to claim 1, wherein the suction head is pivotally mounted to engage the bottom sheet and pull it downwardly, and a driven roller is provided to complete detachment of the sheet and propel it to the other side of the machine for collation together with a pivotally mounted pressure roller to form a driving nip with the driven roller.

* * * * *